United States Patent [19]

McCure

[11] Patent Number: 4,889,309

[45] Date of Patent: Dec. 26, 1989

[54] CUT TREE STAND

[76] Inventor: James O. McCure, 4121 Browns La. D30, Louisville, Ky. 40220

[21] Appl. No.: 217,425

[22] Filed: Jul. 11, 1988

[51] Int. Cl.[4] ..... F16M 13/00

[52] U.S. Cl. ..... 248/524; 24/127; 24/71.2

[58] Field of Search ..... 248/524, 523, 519; 47/42, 40.5; 24/71.2, 127, 118

[56] References Cited

U.S. PATENT DOCUMENTS

| | | | |
|---|---|---|---|
| 679,970 | 8/1901 | Keeler | 248/71.2 X |
| 1,530,690 | 3/1925 | Oliver | 24/118 X |
| 2,444,390 | 6/1948 | White | 248/524 |
| 3,142,464 | 7/1964 | Zelenitz | 248/523 X |
| 3,227,405 | 1/1966 | Layton | 248/524 X |
| 3,353,773 | 11/1967 | Budd | 47/40.5 |
| 3,480,241 | 11/1969 | Moyer | 248/524 X |
| 3,610,558 | 10/1971 | Tawara | 248/524 X |
| 4,130,965 | 12/1978 | Patton et al. | 248/524 X |
| 4,324,023 | 4/1982 | Prete, Jr. | 24/71.2 X |
| 4,700,434 | 10/1987 | Fambrough | 24/71.2 |

*Primary Examiner*—Ramon O. Ramirez
*Attorney, Agent, or Firm*—Jon C. Winger

[57] ABSTRACT

A stand for holding a cut tree in an upright position includes a bowl for receiving the cut end of the tree trunk such that it rests on the base wall of the bowl. Three legs are equally spaced apart from each other around the perimeter of the bowl and are integrally formed at their distal ends with the side wall of the bowl. Each leg has a foot located proximate its distal end for contacting the floor of the facility in which the tree is to be erected such that the only portion of the stand in contact with the facility floor are the soles of the feet. The tree is maintained in the upright position by guys interconnecting the tree trunk to the legs proximate the distal ends of the legs. The stand also includes a device for adjusting the length of the guys so that adjustments can be easily made and the tree will be plumb.

18 Claims, 4 Drawing Sheets

CUT TREE STAND

BACKGROUND OF THE INVENTION

The present invention relates to cut tree stands, and more particularly to a tree stand of unitary construction for holding a decorative tree, such as a Christmas tree in an upright and plumb position.

Cut tree stands are, of course, well known in the art. They vary from simple intersecting boards nailed together to complex stands which fold for storage. Typical examples of heretofore known tree stands are described in, for example, U.S. Pat. No. 2,650,783 issued to F.P. Stanley on Sept. 1, 1953; U.S. Pat. No. 2,652,217 issued to A.J. Schulz on Sept. 15, 1953; U.S. Pat. No. 2,815,908 issued to F.E. Scanland on Dec. 10, 1957; U.S. Pat. No. 2,908,461 issued to D.L. Coffeen on Oct. 13, 1959; U.S. Pat. No. 3,353,773 issued to J.M. Bodal on Nov. 21, 1967; and, U.S. Pat. No. 3,715,095 issued to W.J. Drablowski on Feb. 6, 1973.

Decorative tree stands known to me are generally not very structurally sturdy because they are fabricated of individual components attached together by mechanical fasteners such as nails, screws, or nuts and bolts, depending upon the material of which the stand is made.

An additional drawback to such heretofore known stands is that they are fabricated of materials which decompose or deteriorate due to oxidation or rotting. The decomposition is detrimental to the structural integrity of the stand and also presents an unsightly appearance.

The present invention recognizes these and other drawbacks of the heretofore known tree stands and provides a tree stand which overcomes them and which is also straightforward in construction.

SUMMARY OF THE INVENTION

More particularly, the present invention provides a stand of unitary construction for holding a decorative cut tree in an upright position comprising a bowl to receive the cut bottom end of the tree trunk resting on the base wall of the bowl, a rim extending circumferentially of the bowl and projecting radially outwardly from the peripheral top edge of the side wall of the bowl, the rim being integrally formed with the side wall of the bowl, three legs equally spaced apart from each other around the perimeter of the bowl, extending radially outwardly from the bowl, and integrally formed at their proximal end to the side wall of the bowl and the rim, a foot located proximate the distal end of each leg for contacting the floor upon which the tree is to be located, the sole of the foot being spaced a distance below the bottom longitudinal side of the leg and a distance below the base wall of the bowl, and the foot being integrally formed with the leg.

BRIEF DESCRIPTION OF THE DRAWINGS

A better understanding of the invention will be had upon reference to the following description in conjunction with the accompanying drawings, wherein like numerals identify like parts through the several views and in which.

DETAILED DESCRIPTION OF THE EMBODIMENTS

Figure 1:
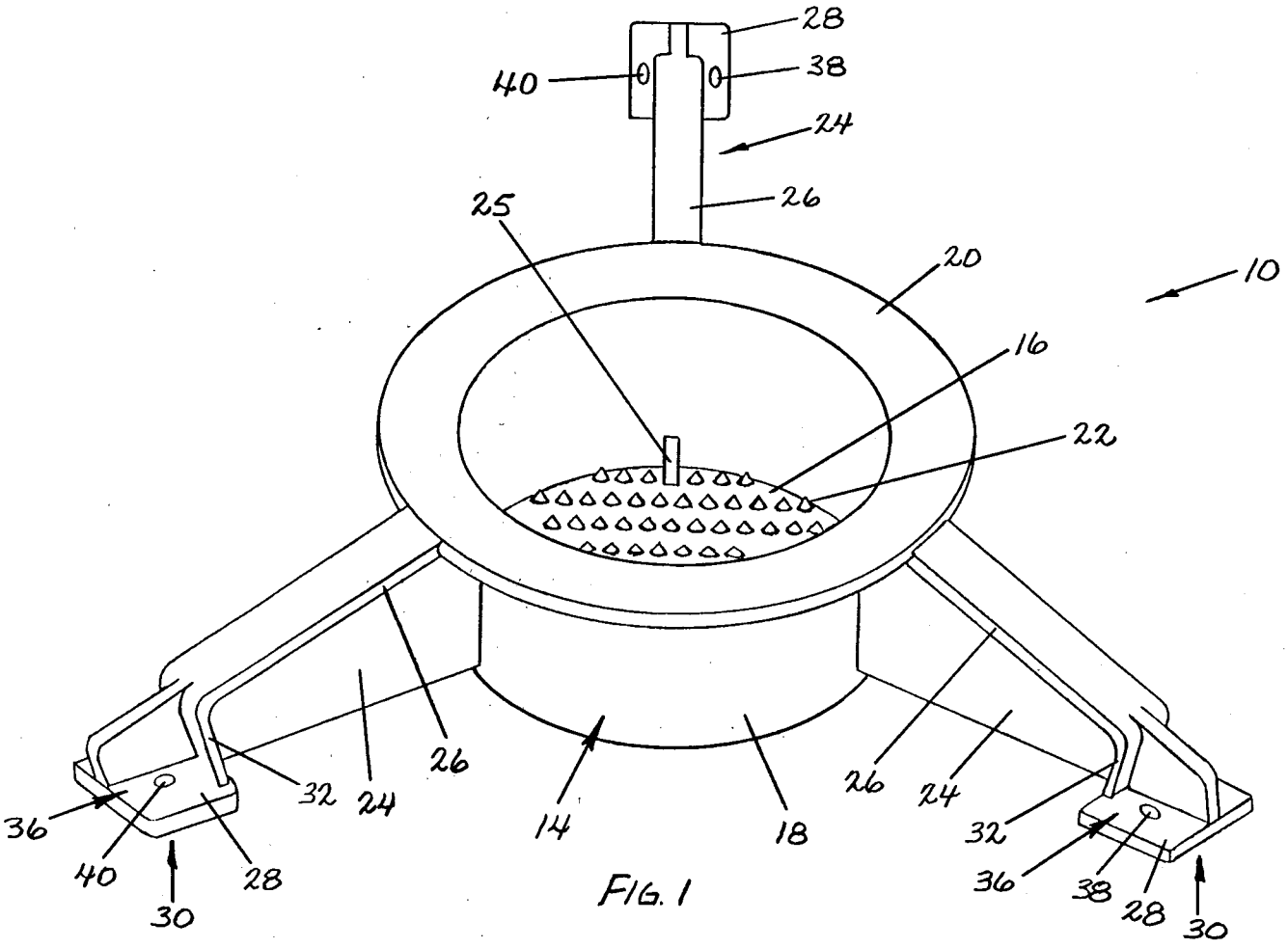
FIG. 1 is a perspective view of the preferred embodiment of the tree stand of the present invention.
Figure 2:
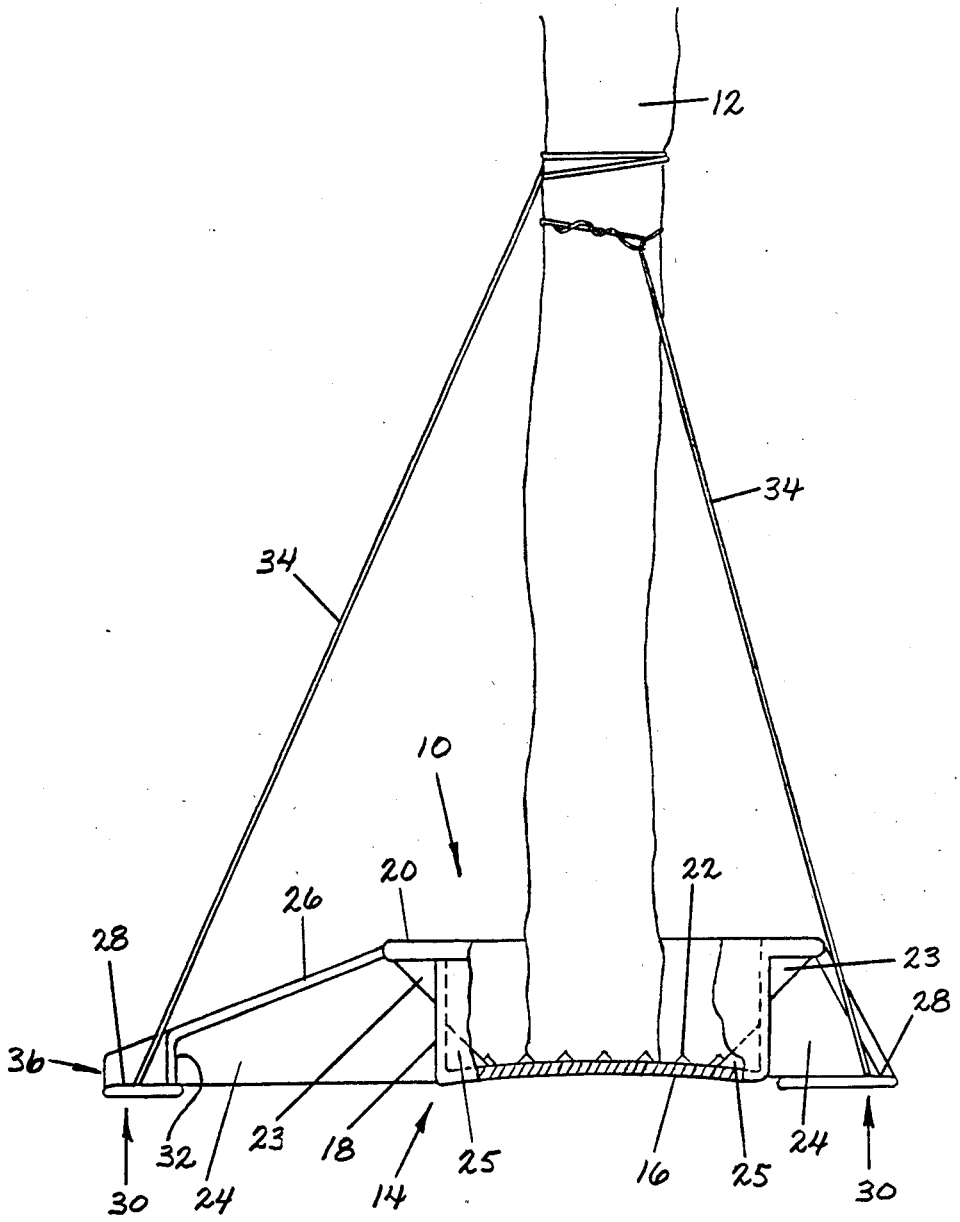
FIG. 2 is a cross-sectional side elevational view of the stand of FIG. 1, illustrating a tree trunk in the stand.

With reference to FIGS. 1 and 2, there is illustrated a tree stand, generally denoted as the numeral 10, for holding a cut decorative tree (the trunk thereof being denoted by the numeral 12 in FIG. 2) upright therein. The stand 10 is particularly useful for holding a cut Christmas tree upright.

The stand 10 includes a bowl, generally denoted as the numeral 14, to receive the cut bottom end of the tree trunk 12. The bowl 10 is of unitary construction and comprises a base wall 16 surrounded by an upstanding perimeter side wall 18 integrally formed with the base wall 16. The bottom portion of the tree trunk 12 is received within the bowl 14 with the cut bottom end resting upon the bowl base wall 16. The bowl base wall 16 is convex or crowned as seen from the inside of the bowl 14 so that it is structurally more rigid than a flat-bottom wall of the same material. The bowl 14 further includes a rim 20 extending circumferentially of the bowl 14 and projecting radially outwardly from the top perimeter edge of the bowl side wall 18. The rim 20 is integrally formed with the side wall 18. An array of spaced apart tooth-like projections or spikes 22 are located at the interior surface of the bowl base wall 16 projecting upwardly therefrom for penetrating the cut end of the tree trunk 12 to prevent the lateral movement of the tree trunk thereby holding it in position on the bowl base wall 16. The spikes 22 are also integrally formed with the bowl base wall 16.

First gusset flanges 23 are located outside of the bowl 14 spaced apart around the circumference of the bowl 14 interconnecting the bottom side of the rim 20 and exterior side of the bowl side wall 18. The first gusset flanges 23 are integrally formed with the rim 20 and bowl side wall 18. Similarly, second gusset flanges 25 are located inside the bowl 14 spaced apart around the circumference of the bowl 14 interconnecting the interior side of the bowl side wall 18 and the interior side of the bowl base wall 16. The second gusset flanges 25 are integrally formed with the bowl base wall 16 and bowl side wall 18.

The stand 10 further includes three legs 24 equally spaced apart from each other around the perimeter of the bowl 14 extending radially outwardly therefrom. The proximal end of each leg is integrally formed with the bowl side wall 16 and the bowl rim 20. As can be best seen in FIG. 2, the proximal end of each leg 24 extends substantially the entire height of the bowl side wall 18 from the juncture of the bowl side wall 18 and bowl base wall 16 to the underside of the bowl rim 20. The bottom longitudinal edge of each leg 24 is substantially parallel to the bowl rim 20 and the top longitudinal edge of each leg 24 converges toward the bottom longitudinal edge of the leg 24 in a direction toward the distal end of the leg 24. Further, each leg 24 includes a first flange 26 extending along the top longitudinal edge from the bowl rim 20 toward the distal end of the leg 24 but terminating at an end a distance short of the distal end of the leg 26. The first flange 24 projects transversely outwardly from both lateral sides of the leg 24. The other end of the first flange 26 is integrally joined to the bowl rim 20 and the first flange 26 is integrally formed along its length with the leg 24.

A foot 28 is located proximate the distal end of each leg 24 at the bottom longitudinal edge of the leg 24 for contacting the floor and supporting the stand 10 thereon. The foot 28 is of such a thickness that the sole 30 of the foot 28 is substantially parallel to the bottom longitudinal edge of the leg and is spaced a distance below the bottom longitudinal edge of the leg 24 and a distance below the bowl base wall 16. The foot 28 extends a distance lengthwise of the leg 24 along the bottom longitudinal edge of the leg 24 from the distal end toward the proximal end of the leg 24 and projects a distance transversely outwardly from both lateral sides of the leg 24 such that the foot is substantially wider than the transverse thickness of the leg 24. The foot 28 is integrally formed with the leg 24.

Each of the legs 24 further includes a second flange 32 extending across the width of the leg 24 proximate the distal end of the leg 24 from the terminal end of the first flange 26 to the foot 28. The second flange 32 projects a distance transversely outwardly from both lateral sides of the leg 24. The second flange 32 is integrally formed with the termainal end of the first flange 26, is integrally formed with the lateral sides of the leg 24, and is integrally formed with the foot 28.

Advantageously, the stand 10 can be fabricated of a moisture impermeable plastic material such as high impact resistant, for example, styrene or propylene plastic, by various molding or casting methods.

Figure 3:
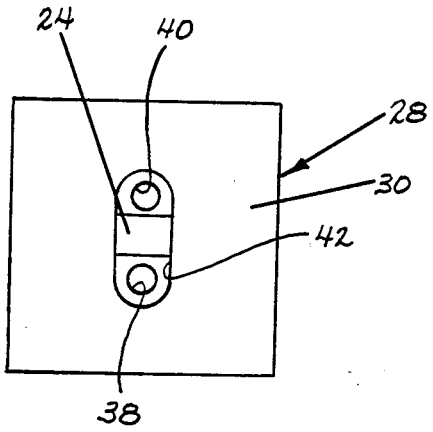
FIG. 3 is an enlarged bottom view of a foot of the stand of FIGS. 1 and 2.
Figure 4:
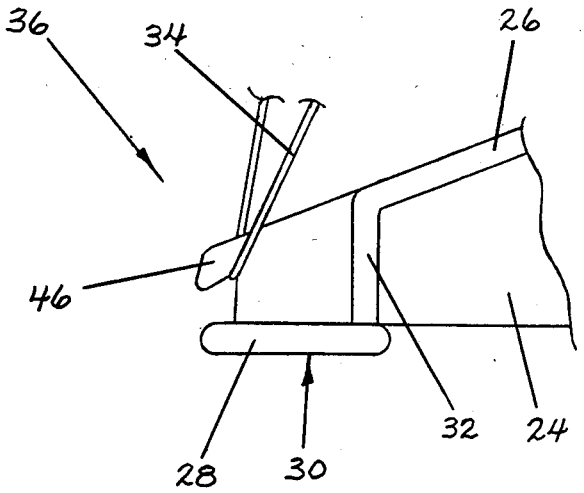
FIG. 4 is an enlarged side view of the distal end of a leg of the stand showing an alternative feature.

The tree is held upright in the stand by guy tethers 34 which are connected at one end to the tree trunk 12 and connected at the other end to the legs 24 of the stand. Toward this objective, the legs 24 each include tether attachment means, generally denoted as the numeral 36, proximate the distal ends of the leg 24. As can be seen in FIGS. 1–3, in one embodiment the tether attachment means 36 comprises two holes 38 and 40 formed through the foot 28 to each lateral side of the leg 24, and a pocket 42 formed in the sole of the foot interconnecting the two holes 38 and 40 and exposing the bottom edge of the leg 24 in the pocket 42. One end 44 of the tether is threaded downwardly from the top surface of the foot toward the sole of the foot through one hole 38 into the pocket 42, across the exposed bottom edge of the leg 24 in the pocket 42, and then upwardly through the other hole 44. The tether end 40 is then secured to the tether 34 above the leg 24 forming a loop in the tether 34 such that the loop encompasses the leg 24 and is recessed in the pocket 42 above the foot sole. Alternatively, as can be seen in FIG. 4, the tether attachment means 36 can include a downwardly opening hook 46 integrally formed at the distal end of each leg 24. In this embodiment the loop in the tether engages the hook 46.

Figure 5:
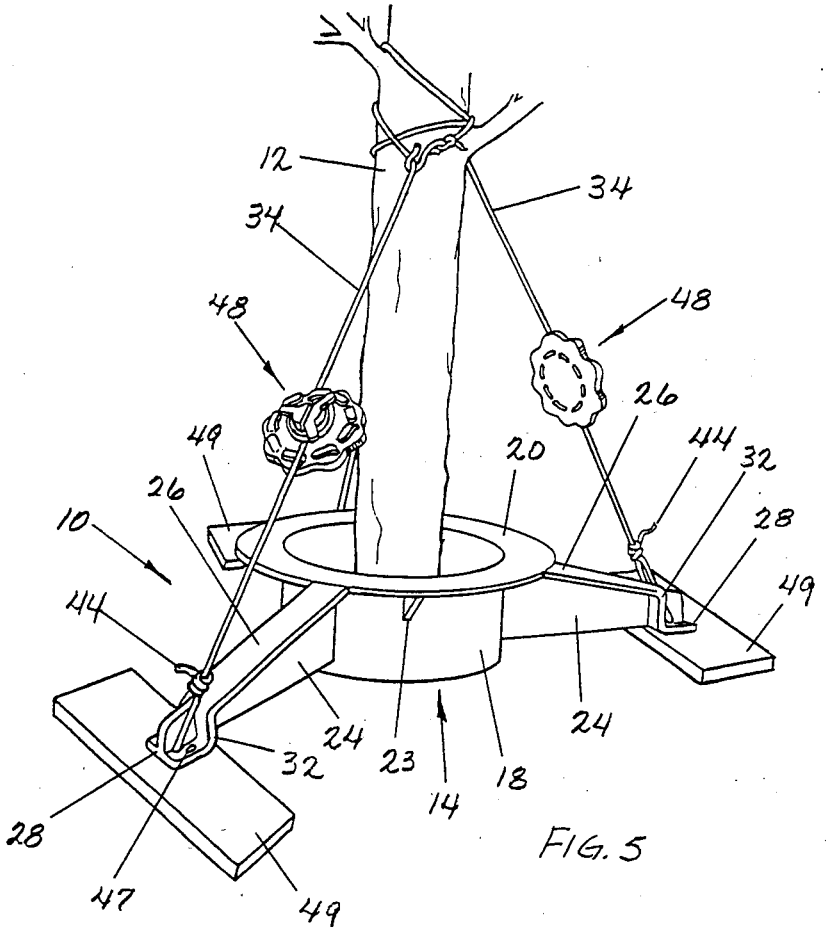
FIG. 5 is a perspective view of the stand illustrating the tree trunk with stand and including guy tether adjustment devices on the tethers holding the tree upright.

With reference to FIG. 5, it may sometimes be required to increase the effective size of the foot 28 if, for example, the tree is particularly tall or top-heavy. Toward this objective, each foot 28 is also formed with apertures 47 therethrough from the top side of the foot to the sole of the foot. A wood plank 49 is positioned beneath each foot 28 abutting the foot sole, and are secured to the foot 28 by fasteners such as screws received through the apertures 47 thereby increasing the effective size of the feet 28.

Figure 6:
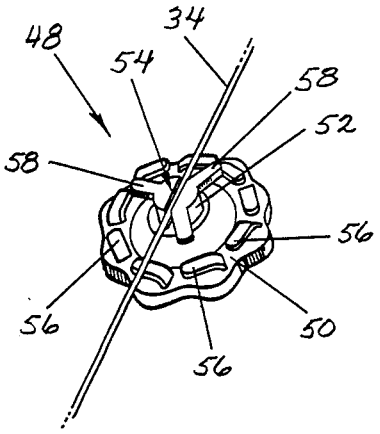
FIG. 6 is a perspective view of a tether adjustment device.
Figure 7:
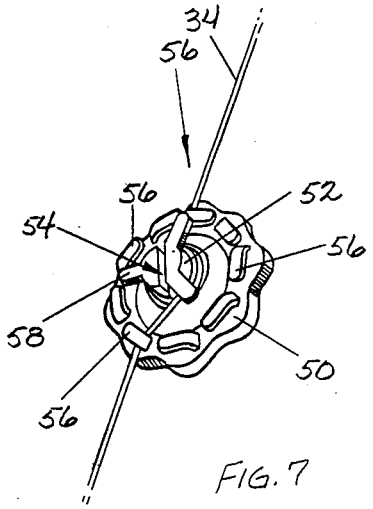
FIG. 7 is a perspective view of the tether adjustment device of FIG. 6 in use.

With reference to FIGS. 2, 5 and 6, the stand also includes tether adjusting devices 48 associated with each tether 34 between the connections of the tether to the tree trunk 12 and stand leg 24 for adjusting the length of the tether 34 interconnecting the tree trunk 12 and leg 24 thereby providing for securing the tree trunk to the stand in an upright position. As can be best seen in FIGS. 6 and 7, the tether adjusting device 48 is separate from the tether 34 so that it can be positioned at any convenient position along the length of the tether 34 even after the tether is secured to the tree trunk 12 and stand leg 24. The tether adjusting device 48 comprises a rim 50 with a winding hub 52 projecting outwardly from the axis of the rim 50 to one side thereof. The winding hub 52 includes a diametric tether receiving slot 54 open to the distal end of the winding hub 52. The depth of the slot 54 is essentially equal to the length of the hub 52. The rim 50 includes at least one tether receiving or locking hook 56 at the side of the rim 50 from which the hub 52 projects at a spaced radial distance outwardly from the hub 52. As shown, the tether adjusting device 48 comprises a plurality of locking hooks 56 circumferentially spaced apart from each other around the hub 52. The locking hooks 56 face in a clockwise direction of the rim 50. In addition, the tether adjusting device 48 also includes finger engaging flanges 58 projecting radially outwardly of the tether winding hub 52 at the distal end thereof. As shown, there are three finger engaging flanges 58 spaced apart circumferentially of the hub 52. In use, as can be seen in FIG. 6, the tether adjusting device 48 is first positioned on the tether 34 with the tether 34 received in and extending across the tether receiving slot 54. As can be seen in FIG. 7, the tether adjusting device 34 is rotated, for example, in a clockwise direction thereby winding the tether 34 around the perimeter of the winding hub 52 shortening the length of the tether. When the desired length of the tether 34 has been obtained, the portions of the tether 34 projecting from the winding hub 52 are engaged in the nearest tether receiving locking hooks 56 locking the tether adjusting device 48 on the tether preventing the movement of the tether adjusting device 48 and thus preventing the unwinding of the tether 34 from around the hub 52. Thusly, it can be readily visualized, that the tether adjusting device 48 can be positioned at any location along the length of the guy tether 34 and provides for incremental adjustment of the length of the tether 34.

The foregoing detailed description is given primarily for clearness of understanding and no unnecessary limitiations are to be understood therefrom for modifications will become obvious to those skilled in the art upon reading this disclosure and may be made without departing from the spirit of the invention and scope of the appended claims.

I claim:

1. A stand of unitary construction for holding a decorative cut tree in an upright position comprising:

a bowl for receiving the bottom portion of the tree trunk, the bowl having a base wall upon which the cut end of the tree trunk rests, and a perimeter side wall integrally formed with the base wall, the base wall being convex as seen from the interior of the bowl;

three legs equally spaced apart from each other around the perimeter of the bowl, extending radially outwardly from the bowl side wall, and each leg is integrally formed at its proximal end with the bowl side wall;

a foot located proximate the distal end of each leg for contacting the floor upon which the tree is to be located, the sole of the foot being spaced a distance below the bottom longitudinal edge of the leg and a distance below the base wall of the bowl, the foot being integrally formed with the leg.

2. A stand of unitary construction for holding a decorative cut tree in an upright position comprising:

a bowl for receiving the bottom portion of the tree trunk, the bowl having a base wall upon which the cut end of the tree trunk rests, a perimeter side wall integrally formed with the base wall, and a rim integral with the side wall and extending circumferentially of the bowl projecting radially outwardly from the top perimeter edge of the side wall;

three legs equally spaced apart from each other around the perimeter of the bowl, extending radially outwardly from the bowl side wall, and each leg is integrally formed at its proximal end with the bowl side wall and integrally formed with the circumferential rim of the bowl, and the proximal end of each leg extends substantially the entire height of the bowl side wall from the juncture of the bowl side wall and bowl base wall to the bowl rim; and, a foot located proximate the distal end of each leg for contacting the floor upon which the tree is to be located, the sole of the foot being spaced a distance below the bottom longitudinal edge of the leg and a distance below the base wall of the bowl, the foot being integrally formed with the leg.

3. The stand of claim 2, wherein the bottom longitudinal edge of each leg is substantially parallel to the bowl rim, and the top longitudinal edge of each leg converges toward the bottom longitudinal edge of the leg in a direction toward the distal end of the leg.

4. The stand of claim 3, wherein the sole of each foot is substantially parallel to the bottom longitudinal edge of the leg.

5. The stand of claim 3, wherein each leg further comprises a first flange extending along the top longitudinal edge from the bowl rim toward the distal end of the leg, projects transversely outwardly from both lateral sides of the leg and is integrally formed along its length with the leg.

6. The stand of claim 5, wherein the first flange terminates at one of its ends proximate the distal end of the leg and is integrally joined at its opposite end to the peripheral edge of the bowl rim.

7. The stand of claim 4, wherein the foot is located at the bottom longitudinal edge of the leg, extends a distance lengthwise of the leg along the bottom edge of the leg from the distal end of the leg toward the proximal end of the leg, and projects a distance transversely outwardly from both lateral sides of the leg such that the foot is substantially wider than the transverse thickness of the leg.

8. The stand of claim 7, further comprising a first flange extending along the top longitudinal edge of each leg from the bowl rim toward the distal end of the leg, projects transversely outwardly from both lateral sides of the leg and is integrally formed along its length with the leg.

9. The stand of claim 8, wherein the first flange terminates at one of its ends proximate the distal end of the leg and is integrally formed at its opposite end to the peripheral edge of the bowl rim.

10. The stand of claim 9, further comprising a second flange extending across the width of each leg proximate the distal end of the leg from the end of the first flange proximate the distal end of the leg to the foot, the second flange projects transversely outwardly from both lateral sides of the leg, the second flange is integrally formed with the first flange, integrally formed along its length with the leg, and integrally formed with the foot.

11. The stand of claim 9, further comprising guy tethers for interconnecting the tree trunk to the distal ends of the legs, and tether attachment means proximate the distal ends of the legs for attaching the tether to the legs.

12. A stand of unitary construction for holding a decorative cut tree in an upright position comprising:

a bowl for receiving the bottom portion of the tree trunk, the bowl having a base wall upon which the cut end of the tree trunk rests, and a perimeter side wall integrally formed with the base wall;

three legs equally spaced apart from each other around the perimeter of the bowl, extending radially outwardly from the bowl side wall, and each leg is integrally formed at its proximal end with the bowl side wall;

a foot located proximate the distal end of each leg for contacting the floor upon which the tree is to be located, the sole of the foot being spaced a distance below the bottom longitudinal edge of the leg and a distance below the base wall of the bowl, the foot being integrally formed with the leg;

guy tethers for interconnecting the tree trunk to the distal ends of the legs; and tether attachment means comprising two holes formed through each foot to each lateral side of the leg, and a pocket formed in the sole of the foot interconnecting the two holes and exposing the bottom edge of the leg in the pocket.

13. The stand of claim 12, wherein the tether attachment means comprises a downwardly opening hook integrally formed with each leg at the distal end of the leg.

14. The stand of claim 12, further comprising a tether adjusting means separate from but attachable to each guy tether for adjusting the length of the tether comprising a winding hub about which the tether is wound, and tether receiving locking hooks spaced radially outwardly of the hub.

15. The stand of claim 14, wherein the tether adjusting means further comprises a diametric tether receiving slot formed in the hub.

16. The stand of claim 15, wherein the tether adjusting means comprises a rim having the winding hub projecting outwardly from at least one side at the axis of the rim, and the tether locking hooks are attached to the rim circumferentially spaced apart from each other around the hub.

17. A tether adjusting device for adjusting the length and tension of a tether attached to two objects at its opposite ends comprising a winding hub about which the tether is wound, a tether receiving slot formed in diametrically of the hub, and tether receiving locking hooks spaced radially outwardly of the hub.

18. The tether adjusting device of claim 17, comprising:

a rim having the winding hub projecting outwardly from at least one side at the axis of the rim;

the tether locking-hooks are attached to the rim circumferentially spaced apart from each other around the hub; and, the diametric tether receiving slot in the hub is open to the distal end of the hub.

* * * * *